US012753623B2

(12) United States Patent
Jeon

(10) Patent No.: US 12,753,623 B2
(45) Date of Patent: Oct. 6, 2026

(54) SEISMIC REINFORCEMENT STRUCTURE AND SEISMIC CONSTRUCTION METHOD

(71) Applicant: TRAUM WOOD HOUSE Corp., Sejong-si (KR)

(72) Inventor: Jaehwan Jeon, Sejong-si (KR)

( * ) Notice: Subject to any disclaimer, the term of this patent is extended or adjusted under 35 U.S.C. 154(b) by 167 days.

(21) Appl. No.: 18/739,915

(22) Filed: Jun. 11, 2024

(65) Prior Publication Data

US 2025/0361742 A1 Nov. 27, 2025

(30) Foreign Application Priority Data

May 22, 2024 (KR) ..... 10-2024-0066193

(51) Int. Cl.
*E04H 9/02* (2006.01)

(52) U.S. Cl.
CPC ..... *E04H 9/0237* (2020.05)

(58) Field of Classification Search
CPC ..... E04H 9/0237; E04H 9/021; E04H 9/027
See application file for complete search history.

(56) References Cited

U.S. PATENT DOCUMENTS 4,699,547 A * 10/1987 Seegmiller ..... E21D 11/006 405/259.1
5,115,615 A * 5/1992 Miyake ..... E04F 15/024 52/480
5,185,976 A * 2/1993 Miyake ..... F16F 13/007 52/167.6
5,491,935 A * 2/1996 Coxum ..... E04H 9/14 52/92.1
5,531,054 A * 7/1996 Ramirez ..... E04H 9/14 52/95
5,761,863 A * 6/1998 Sutt, Jr. ..... E04B 7/04 403/231
5,832,679 A * 11/1998 Roth ..... E04H 9/0237 52/167.3
6,427,391 B1 * 8/2002 Lyons ..... E04B 1/003 52/289
6,560,940 B2 * 5/2003 Mueller ..... E04B 1/2604 411/536
6,843,027 B2 * 1/2005 Gaddie ..... E04H 9/14 52/223.13
7,299,593 B1 * 11/2007 diGirolamo ..... E04B 2/58 52/274
7,665,257 B2 * 2/2010 Posey ..... E04B 7/04 52/223.13
7,971,411 B2 * 7/2011 Commins ..... E04B 1/2604 52/293.3

(Continued)

FOREIGN PATENT DOCUMENTS

KR 10-2017-0055501 A 5/2017
KR 20170055501 A * 5/2017 ..... F16F 15/04

*Primary Examiner* — Rodney Mintz
(74) *Attorney, Agent, or Firm* — KORUS Patent, LLC; Seong Il Jeong

(57) ABSTRACT

Disclosed herein is a seismic reinforcement structure for a wooden structure building including a floor part, a wall vertically connected to the floor part, and a ceiling part vertically connected to the wall and arranged parallel to the floor part. The seismic reinforcement structure includes: a first bracket connecting the top surface of the floor part and the inner surface of one side of the wall; and a second bracket connecting the bottom surface of the ceiling part and the inner surface of the other side of the wall.

8 Claims, 14 Drawing Sheets

(56) References Cited

U.S. PATENT DOCUMENTS 8,079,188 B2 * 12/2011 Swartz ..... E04H 9/10 52/653.1
8,215,068 B2 * 7/2012 Bongiorno ..... E04C 5/165 52/167.6
8,356,449 B2 * 1/2013 Lin ..... E04B 1/2604 52/703
8,434,281 B2 * 5/2013 Halfon ..... E06B 3/4636 49/504
8,511,025 B2 * 8/2013 Kawai ..... E04H 9/0237 52/393
8,925,267 B1 * 1/2015 Kirby ..... E04G 23/0218 52/514
8,943,777 B2 * 2/2015 Espinosa ..... E04B 1/4121 52/223.13
8,950,126 B2 * 2/2015 Imai ..... E04H 9/02 52/764
9,091,056 B2 * 7/2015 Stauffer ..... E04C 5/0645
9,097,000 B2 * 8/2015 Espinosa ..... E04B 1/2604
9,371,658 B2 * 6/2016 Crumley ..... F16B 31/028
9,689,173 B2 * 6/2017 Wu ..... E04H 9/0237
9,874,009 B2 * 1/2018 Espinosa ..... E04B 1/4157
9,989,349 B2 * 6/2018 Saxey ..... E04C 3/293
10,081,961 B1 * 9/2018 Blomgren ..... E04H 9/14
10,267,053 B2 * 4/2019 Blomgren ..... E04B 2/56
10,337,185 B2 * 7/2019 Espinosa ..... E04H 9/14
10,364,569 B2 * 7/2019 Crumley ..... F16B 31/028
10,753,081 B2 * 8/2020 Espinosa ..... E04B 1/2604
10,883,263 B1 * 1/2021 Fujisaki ..... E04B 1/26
11,105,110 B2 * 8/2021 Watson ..... E04C 2/34
11,136,754 B2 * 10/2021 Espinosa ..... E02D 27/34
11,293,183 B2 * 4/2022 Guo ..... E04H 9/021
11,313,144 B2 * 4/2022 Jeon ..... E04H 9/027
11,753,813 B2 * 9/2023 Espinosa ..... E04H 9/14 52/293.3
11,761,198 B2 * 9/2023 Espinosa ..... E04B 2/70 52/293.3
12,385,276 B2 * 8/2025 Espinosa ..... E04B 1/2604
12,546,134 B2 * 2/2026 Espinosa ..... E04B 2/707
2002/0020136 A1 * 2/2002 Mueller ..... E04B 1/2604 52/712
2003/0136075 A1 * 7/2003 Brackett ..... E04B 1/26 52/712
2003/0230032 A1 * 12/2003 Shahnazarian ..... E04H 9/14 52/223.13
2004/0118053 A1 * 6/2004 Huppert ..... E04C 3/02 52/23
2004/0134140 A1 * 7/2004 Gaddie ..... E04H 9/14 52/223.1
2005/0193681 A1 * 9/2005 Brackett ..... E04H 9/028 52/698
2008/0148655 A1 * 6/2008 Posey ..... E04B 1/26 52/92.2
2009/0107082 A1 * 4/2009 Commins ..... E04H 9/14 52/745.12
2009/0158679 A1 * 6/2009 Swartz ..... E04H 9/10 52/272
2009/0193736 A1 * 8/2009 Halfon ..... E06B 3/4636 49/70
2010/0088997 A1 * 4/2010 Lin ..... E04B 1/2604 52/712
2010/0101160 A1 * 4/2010 Bongiorno ..... E04C 5/03 52/741.3
2010/0115866 A1 * 5/2010 Espinosa ..... E04B 1/08 52/712
2011/0041449 A1 * 2/2011 Espinosa ..... E02D 35/00 52/698
2011/0107699 A1 * 5/2011 Kawai ..... E04H 9/0237 52/698
2012/0304589 A1 * 12/2012 Commins ..... E04B 1/2604 52/745.21
2014/0090315 A1 * 4/2014 Imai ..... E04B 1/2604 52/167.1
2015/0184371 A1 * 7/2015 Stauffer ..... E04C 5/0645 52/701
2015/0204369 A1 * 7/2015 Crumley ..... E04C 1/39 411/10
2016/0076239 A1 * 3/2016 Espinosa ..... E04B 1/4157 52/293.3
2016/0244960 A1 * 8/2016 Espinosa ..... E04B 1/2604
2016/0369499 A1 * 12/2016 Crumley ..... E04B 2/20
2017/0030701 A1 * 2/2017 Saxey ..... E04H 9/024
2017/0058514 A1 * 3/2017 Wu ..... E04H 9/0237
2017/0089063 A1 * 3/2017 Espinosa ..... E02D 35/00
2017/0268224 A1 * 9/2017 Sato ..... E04H 4/148
2018/0363317 A1 * 12/2018 Blomgren ..... E04H 9/14
2020/0024843 A1 * 1/2020 Espinosa ..... E02D 35/00
2020/0102751 A1 * 4/2020 Guo ..... E04C 5/03
2020/0208419 A1 * 7/2020 Watson ..... E04C 2/46
2020/0248470 A1 * 8/2020 Jeon ..... E01C 11/18
2021/0002889 A1 * 1/2021 Espinosa ..... E04B 1/4121
2021/0108434 A1 * 4/2021 Espinosa ..... E04H 9/14
2021/0310267 A1 * 10/2021 Espinosa ..... E04B 2/707
2022/0228392 A1 * 7/2022 Watson ..... E04B 2/02
2023/0061052 A1 * 3/2023 Espinosa ..... E04B 1/4121
2024/0044128 A1 * 2/2024 Espinosa ..... E02D 35/00
2024/0337130 A1 * 10/2024 Espinosa ..... E04B 2/707
2025/0270837 A1 * 8/2025 Espinosa ..... E04B 2/706

* cited by examiner

Prior Art

Prior Art

Prior Art

Prior Art

Prior Art

Prior Art

Prior Art

Prior Art

SEISMIC REINFORCEMENT STRUCTURE AND SEISMIC CONSTRUCTION METHOD

CROSS-REFERENCE TO RELATED APPLICATION

This application claims the benefit of Korean Patent Application No. 10-2024-0066193 filed on May 22, 2024, which is hereby incorporated by reference herein in its entirety.

BACKGROUND

1. Technical Field

The present invention relates to seismic reinforcement, and more specifically to a seismic reinforcement structure that can be installed in a lightweight wooden structure and improve earthquake resistance, and a seismic construction method.

2. Description of the Related Art

Earthquakes are phenomena in which energy from inside the Earth comes out to the surface and causes the ground to crack and shake. The shaking that occurs in this case acts as a load on a building and causes enormous damage to the building. In Korea, earthquake-resistant design is mandatory for all wooden houses, including single-family houses, regardless of the number of floors and area.

In order to ensure that buildings meet earthquake-resistant design standards, many technologies have been developed to improve earthquake resistance. For example, in Korean Patent Application Publication No. 10-2017-0055501, a damper is installed in a building and absorbs vibration energy caused by an earthquake.

However, the conventional earthquake resistance improvement technology described above can only be applied when a target building is a heavy building, and a seismic reinforcement structure configured to improve earthquake resistance is also heavy and expensive. Accordingly, this technology has a limitation to application to lightweight wooden buildings. Furthermore, although about 30 years have elapsed since the American-style lightweight wooden housing construction method was introduced to Korea, there is almost no seismic reinforcement technology suitable for the characteristics of topographical structure of Korea. Therefore, there is an urgent demand for the development of a seismic reinforcement structure that can be applied to lightweight wooden buildings.

SUMMARY

The present invention has been conceived to overcome the above-described problems, and an object of the present invention is to provide a seismic reinforcement structure that is applicable to a lightweight wooden building and is lightweight and economical.

The objects of the present invention are not limited to the object mentioned above, and other objects not mentioned can be clearly understood from the description below.

According to an aspect of the present invention, there is provided a seismic reinforcement structure for a wooden structure building including a floor part, a wall vertically connected to the floor part, and a ceiling part vertically connected to the wall and arranged parallel to the floor part, the seismic reinforcement structure including: a first bracket connecting the top surface of the floor part and the inner surface of one side of the wall; and a second bracket connecting the bottom surface of the ceiling part and the inner surface of the other side of the wall; wherein the first bracket includes a horizontal portion formed as a plane without bending and coupled to the top surface of the floor part, a vertical portion formed as a plane without bending and coupled to the inner surface of the one side of the wall, and a curved portion formed to have a predetermined radius of curvature without bending and connecting one end of the horizontal portion and one end of the vertical portion; wherein the second bracket includes a horizontal portion formed as a plane without bending and coupled to a top surface of the ceiling part, a vertical portion formed as a plane without bending and coupled to the inner surface of the other side of the wall, and a curved portion formed to have a predetermined radius of curvature without bending and connecting one end of the horizontal portion and one end of the vertical portion of the second bracket; wherein the horizontal portion of the first bracket and the horizontal portion of the second bracket are connected by a connection support rod extending vertically, so that when an earthquake occurs, the left and right vibration of the wall is allowed by the first and second brackets, which are each formed of flat surfaces without bending and a curved surface; wherein the left and right vibration of the wall is limited by the connection support rod connecting the horizontal portions of the first and second brackets; and wherein a reinforcing bracket is installed between the wall and the connection support rod at an intermediate height between the first and second brackets, has a sideways "U" shape when viewed from the side, and includes a flat upper plate, a flat lower plate facing the upper plate, and a side plate connecting the upper and lower plates and extending in the height direction.

Through holes may be perforated in the upper and lower plates of the reinforcing bracket, respectively, to allow the connection support rod to pass therethrough, the connection support rod may be fastened to the through holes in the upper and lower plates with a fastening nut, a washer located in contact with the fastening nut, and an elastic washer placed in contact with the other side of the washer and simultaneously placed in contact with the upper and lower plates, and the elastic washer may be made of rubber and have a larger diameter than the fastening nut, thereby providing an elastic body serving as a damper.

Each of the first and second brackets may be coupled to the connection support rod with a fastening nut, a washer placed in contact with the fastening nut, and an elastic washer placed in contact the other surface of the washer and placed with simultaneous contact with the floor and ceiling parts, so that elastic bodies provided by the elastic washers are installed the upper, lower, and intermediate points of the connecting support rod.

The reinforcing bracket may be made of ATOS780 that is automobile structural steel (ATOS) and is not subjected to a hot forming process.

The connection support rod may include a plurality of threaded rods formed to be long vertically, having a male thread formed on an outer surface thereof, and arranged one after another in a vertical direction, and a connector formed in the shape of a tube and having a female thread formed on the inner circumferential surface thereof, and configured such that the threaded rods arranged successively are respectively screwed thereinto on both ends thereof, and may allow the length and tension thereof to be adjusted.

The connection support rod may vertically pass through the horizontal portions of the first and second brackets and the ceiling part of the building, so that the upper end thereof is fixed to the ceiling part and the lower end thereof is inserted into the floor part of the building; and the seismic reinforcement structure may further include an anchor that is provided to surround the lower end of the connection support rod in the portion of the floor part in which the lower end of the connection support rod is inserted and that fixes the connection support rod.

The seismic reinforcement structure may further include an anchor that has a predetermined shape and includes an insertion portion buried in the floor part and a protrusion extending upward from the insertion part, vertically passing through the first bracket, and protruding upward from the floor part; and the connection support rod may vertically pass through the horizontal portion of the second bracket and the ceiling part of the building, so that the upper end thereof is fixed to the ceiling part and the lower end thereof is connected to the top of the protrusion.

The wall may include a first wall and a second wall connected perpendicularly to the first wall, and the connection portions of the first and second walls may provide a corner portion; the first bracket, the second bracket, the reinforcing bracket, and the connection support rod may form a first seismic module and be installed at the corner portion connected to the first wall; and another additional first bracket, second bracket, reinforcing bracket, and connection support rod may form a second seismic module and be installed at the corner portion connected to the second wall, so that the corner portions of the walls are supported by the first and second seismic modules in a dual manner and also improve earthquake resistance.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Figure 1:
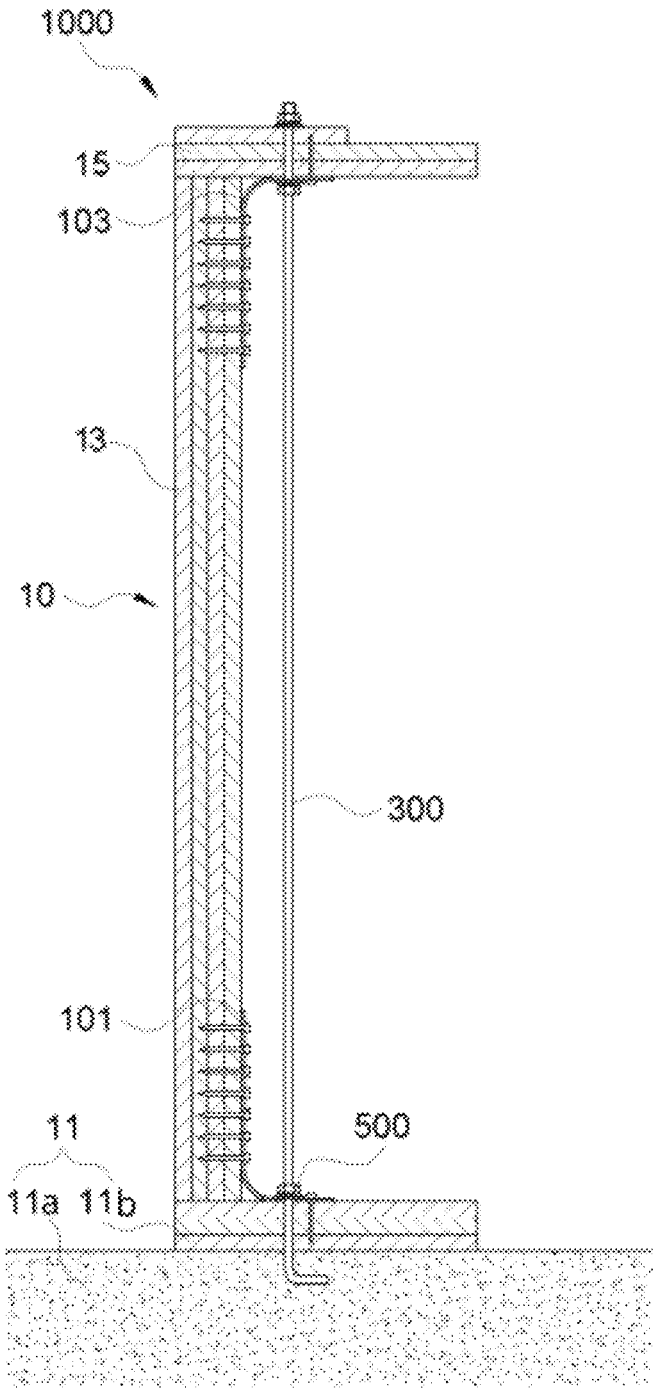
FIG. 1 is a side sectional view showing a state in which a seismic reinforcement structure according to an embodiment of the present invention is installed in a building.

Prior to the following description of the technical spirit of the present invention to be given in more detail with reference to the accompanying drawings, the terms and words used in the present specification and the attached claims should be interpreted as having meanings and concepts consistent with the technical spirit of the present invention based on the principles in which the terms and the words should not be construed as limited to their usual or dictionary meanings and an inventor can appropriately define the concepts of terms in order to describe his or her invention in the best way.

Accordingly, the embodiments described in this specification and the configurations shown in the drawings are only embodiments of the present invention and do not represent the overall technical spirit of the present invention. Therefore, it should be understood that there may be various modifications that can replace these at the time when the present application is filed.

Hereinafter, the technical spirit of the present invention will be described in more detail with reference to the accompanying drawings. The accompanying drawings show only the examples intended to illustrate the technical spirit of the present invention in more detail, so that the technical spirit of the present invention is not limited to the forms of the accompanying drawings.

[Seismic Reinforcement Structure]

FIG. 1 is a side sectional view showing a state in which a seismic reinforcement structure according to an embodiment of the present invention is installed in a building.

As shown in FIG. 1, the seismic reinforcement structure 1000 according to an embodiment of the present invention is applied to a lightweight wooden building 10 to improve the earthquake resistance of the building 10. The seismic reinforcement structure 1000 basically includes a first bracket 101, a second bracket 103, an anchor 500, and a connection support rod 300.

Prior to the description of the structures of the individual components, the structure of the building 10 to which the seismic reinforcement structure 1000 according to an embodiment of the present invention may be applied will be briefly described. The building 10 includes: a floor part 11 including a first floor layer 11*a* reinforced with reinforcing bars placed inside the ground and made of concrete and a second floor layer 11*b* made of lightweight wood stacked on the first floor layer 11*a*; a wall 13 installed to stand vertically with respect to the floor part 11 in order to form a predetermined space above the floor 11; and a ceiling part 15 configured to cover the top of the space surrounded by the wall 13 and be installed in vertical contact with the wall 13.

The first bracket 101 is installed in an area where the floor part 11 and the wall 13 come into contact with each other, and serves to support the wall 13 when the wall 13 is shaken to the left and right due to an earthquake or the like. The second bracket 103 is installed in the area where the ceiling part 15 and the wall 13 come into contact with each other. The second bracket 103 also serves to support the wall 13 when the wall 13 is shaken to the left and right due to an earthquake or the like.

Figure 2:
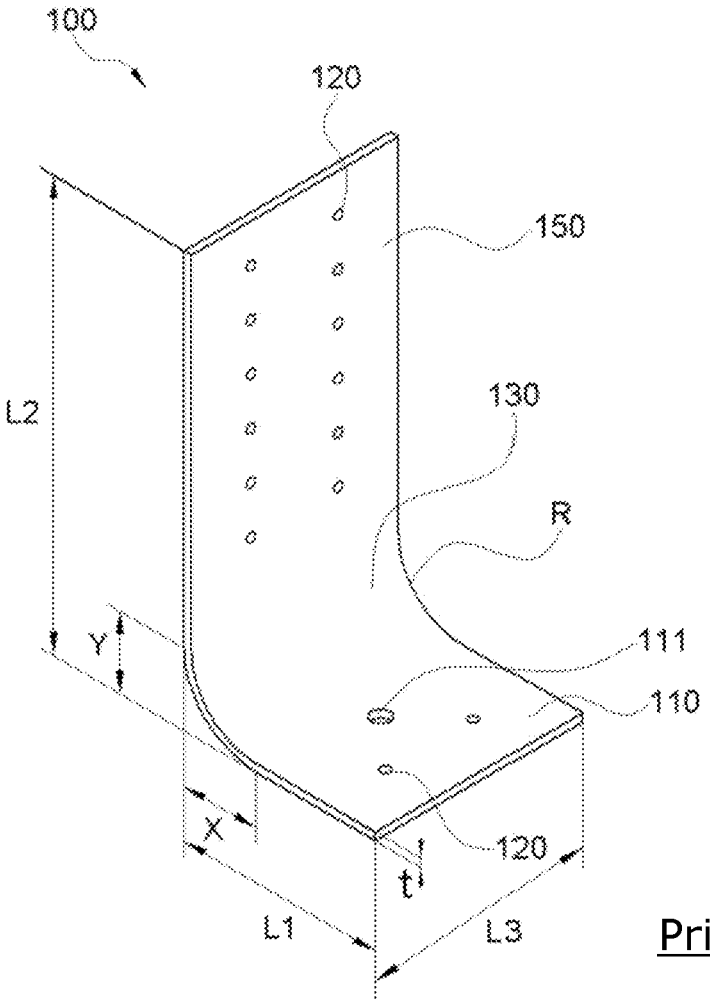
FIG. 2 is a perspective view showing the configuration of a first or second bracket.

FIG. 2 is a perspective view showing the configuration of the first bracket or the second bracket.

Since the first bracket 101 and the second bracket 103 are formed in the same shapes, the first bracket 101 and the second bracket 103 will be referred to as brackets 100 below, and the shapes thereof will be described together with reference to FIG. 2. Each of the brackets 100 is formed to include a horizontal portion 110, a vertical portion 150, and a curved portion 130. The horizontal portion 110 and the vertical portion 150 are each formed to extend a predetermined length, and are connected perpendicularly to each other. The curved portion 130 connecting the vertical portion 150 and the horizontal portion 110 and having a constant radius of curvature R is formed between the vertical portion 150 and the horizontal portion 110.

The horizontal portion 110 is a portion in contact with the floor or ceiling of a building, and the vertical portion 150 is a portion in contact with a wall of the building. When the extension direction of the horizontal portion 110 is referred to as a first direction and the length of the bracket 100 in the first direction is L1, a length L2 in the second direction, which is the extension direction of the vertical portion 150, is formed in the range of 1.5L1 or more and 4L1 or less, preferably the range of 1.7L1 or more and 3.2L1 or less, more preferably 1.9L1 or more and 2.1L1 or less. The above-described length ratio between the length L1 in the first direction and the length L2 in the second direction of the bracket 100 is a value that is determined by taking into consideration the problem in which when the length L2 in the second direction is excessively long compared to the length L1 in the first direction, the load acting on the horizontal portion 110 increases, so that it can be easily damaged and the problem in which conversely, when the length L1 in the second direction is excessively short, the load applied from the wall cannot be supported, the wall easily collapses when vibration occurs in the left and right directions.

Furthermore, when the length of the bracket 100 in the first direction is L1, the length L3 in the widthwise direction of the bracket 100, i.e., a third direction perpendicular to the first and second directions, is formed in the range of 0.1L1 to 0.4L1, preferably the range of 0.2L1 to 0.3L1, more preferably the range of 0.22L1 to 0.25L1. Furthermore, the thickness t of the bracket 100 is formed in the range of 0.1L3 to 0.2L3, preferably the range of 0.12L3 to 0.15L3, more preferably the range of 0.13L3 to 0.14L3.

Figure 3:
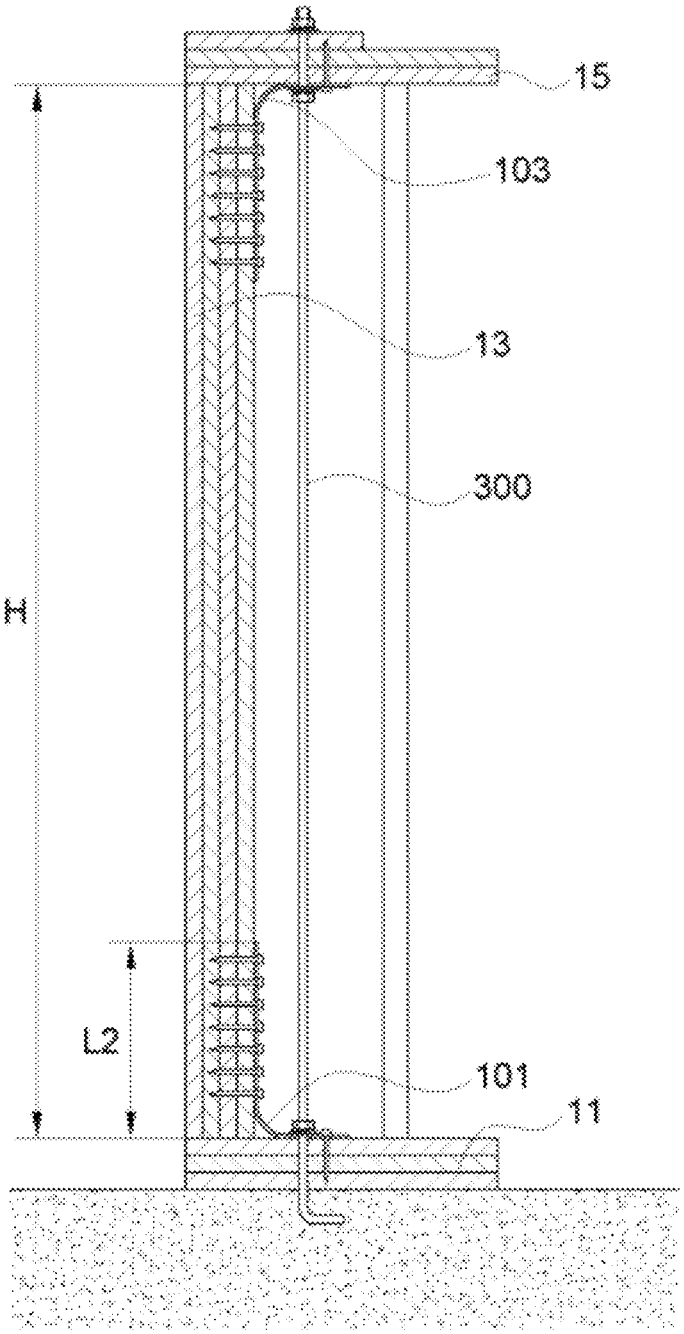
FIG. 3 is a side sectional view showing a state in which the first bracket and the second bracket are installed in a building.

FIG. 3 is a side sectional view showing a state in which the first bracket and the second bracket are installed in a building.

Referring to FIG. 3, when the height of the wall 13 of the building is H, the length L2 in the second direction is formed in the range of 0.1H to 0.4H, preferably the range of 0.1H to 0.2H, more preferably 0.125H.

Referring again to FIG. 2, the shape of the curved portion 130 will be described. The curved portion 130 is formed to connect the horizontal portion 110 and the vertical portion 150 to each other as described above, and is formed to have a constant radius of curvature R. In this case, the radius of curvature R is formed in the range of 0.1L1 to 0.5L1, preferably the range of 0.2L1 to 0.3L1, more preferably the range of 0.2L1 to 0.25L1. Furthermore, the length of the curved portion 130 in the first direction is in the range of 0.1L1 to 0.7L1, preferably the range of 0.3L1 to 0.6L1, most preferably the range of 0.4L1 to 0.5L1. The length of the curved portion 130 in the second direction is formed in the range of 0.1L2 to 0.5L2, preferably the range of 0.2L2 to 0.4L2, most preferably the range of 0.2L2 to 0.3L2. In the bracket 100 included in the seismic reinforcement structure according to an embodiment of the present invention, the curved portion 130 has a radius of curvature R, and the length of the curved portion 130 in the first direction and the length of the curved portion 130 in the second direction are formed in the ranges described above. Accordingly, the phenomenon of stress concentration on the connection area between the horizontal portion 110 and the vertical portion 150 is reduced. As a result, the bracket 100 has the advantage of not being easily damaged when vibration occurs in the left and right directions.

When the first bracket 101 and the second bracket 103 are installed in a building, the horizontal portion 110 of the first bracket 101 extends in contact with the floor part of the building and the vertical portion 150 of the first bracket 101 is installed to extend in contact with the wall of the building, and the horizontal portion 110 of the second bracket 103 extends in contact with the ceiling part of the building and the vertical portion 150 of the second bracket 103 is installed to extend in contact with the wall of the building.

Furthermore, the horizontal portion 110 of the first bracket 101 and the horizontal portion 110 of the second bracket 103 are arranged such that they are located on the same line in a vertical direction when installed in a building.

A through hole 111 into which the connection support rod or anchor to be described later is inserted is formed in the horizontal portion 110. The formation position of the through hole 111 is formed on the side where the curved portion 130 is formed based on the first direction, and is formed at the center of the horizontal portion 110, i.e., at a point of 0.5L3, based on the third direction. The diameter of the through hole 111 is preferably formed in the range of 0.2L3 to 0.25L3. For example, when the third direction length L3 of the bracket is formed to be 90 mm, the diameter of the through hole 111 is approximately in the range of 18 mm to 22.5 mm, most preferably 20 mm.

For reference, the first bracket 101 and the second bracket 103 have been described as arranged such that the respective horizontal portions 110 thereof are located on the same line in the vertical direction when installed in a building. More precisely, it is preferable that the through hole 111 of the first bracket 101 and the through hole 111 of the second bracket 103 are arranged to be located on the same line in the vertical direction.

The horizontal and vertical portions 110 and 150 of the first and second brackets 101 and 103 are fixed to the floor part, the wall, and the ceiling part through pieces (not shown). For this purpose, piece holes 120 are formed in each of the horizontal and vertical portions 110 and 150. The piece holes 120 are formed in pairs in the third direction, i.e., the widthwise direction, and have a diameter in the range of 0.07L3 to 0.075L3. For example, when L3 is 90 mm, the diameter of the piece holes 120 is formed to be in the range of 6.3 mm to 6.75 mm, preferably 6.5 mm.

In detail, the locations of the piece holes 120 formed in the horizontal portion 110 are points spaced apart from the side on which the vertical portion 150 is formed by a length in the range of 0.7L1 to 0.9L1, more precisely a length of 0.8L1, in the first direction. This prevents the problem in which earthquake resistance is reduced because the bracket 100 is not able to move flexibly when vibration occurs in the left and right directions in the case where the piece holes 120 are formed excessively close to the curved portion 130. In addition, the through hole 111 is formed to distribute the load applied to the pieces to be fastened to the piece holes 120 by the connection support rod, which will be described later.

The piece holes 120 formed in the vertical portion 150 are also formed in the range of the points spaced apart from the side on which the horizontal portion 110 is formed by 0.25L2 in the second direction for the same reason as the piece holes 120 formed in the horizontal portion 110 to the points spaced apart from the starting points by intervals of 0.125L2 in the second direction. In this case, the number of pairs of piece holes 120 formed in the vertical portion 150 is in the range of 1 to 6. This value is obtained by taking into consideration the fact that the maximum number of pieces that can be inserted into the piece holes 120 within the range that does not affect the fatigue level of the bracket 100 is 12. For reference, it is obvious that the number of pairs of piece holes 120 formed in the vertical portion 150 is most preferably 6.

Figure 5:
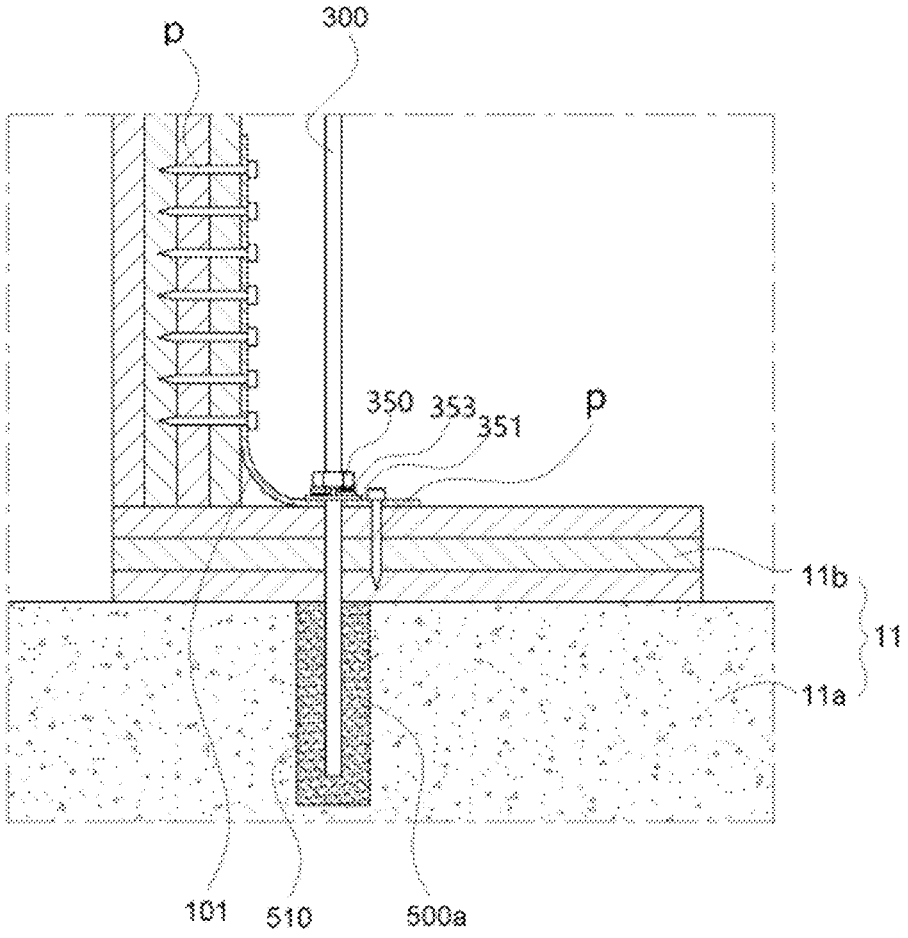
FIG. 5 is a side sectional view showing the configuration of an anchor used when a seismic reinforcement structure according to an embodiment of the present invention is applied to a previously constructed building.

Referring to FIG. 5, the pieces p inserted into the piece holes 120, respectively, are galvanized wood pieces, and are formed to have a diameter in the range of 0.06L3 to 0.07L3 and to have a length in the range of 0.8 to 0.9 times the thickness of the second bottom layer 11*b*. For example, when L3 is 90 mm and the thickness of the second bottom layer 11*b* is 126 mm, the pieces p have a diameter in the range of 5.4 mm to 6.3 mm and a length in the range of 100.8 mm to 113.4 mm. Preferably, the pieces p are formed to have a diameter of 6 mm and a length of 112 mm.

The connection support rod 300 is formed to be long vertically as shown in FIG. 3, and has a rod shape in which a male thread is formed on its outer surface. The connection support rod 300 vertically connects the horizontal portions of the first and second brackets 101 and 103 to each other. The connection support rod 300 is installed as described above, and serves to maintain a constant distance between the floor part 11 and the ceiling part 15 when vibration in the vertical direction acts on the building 10.

Figure 4:
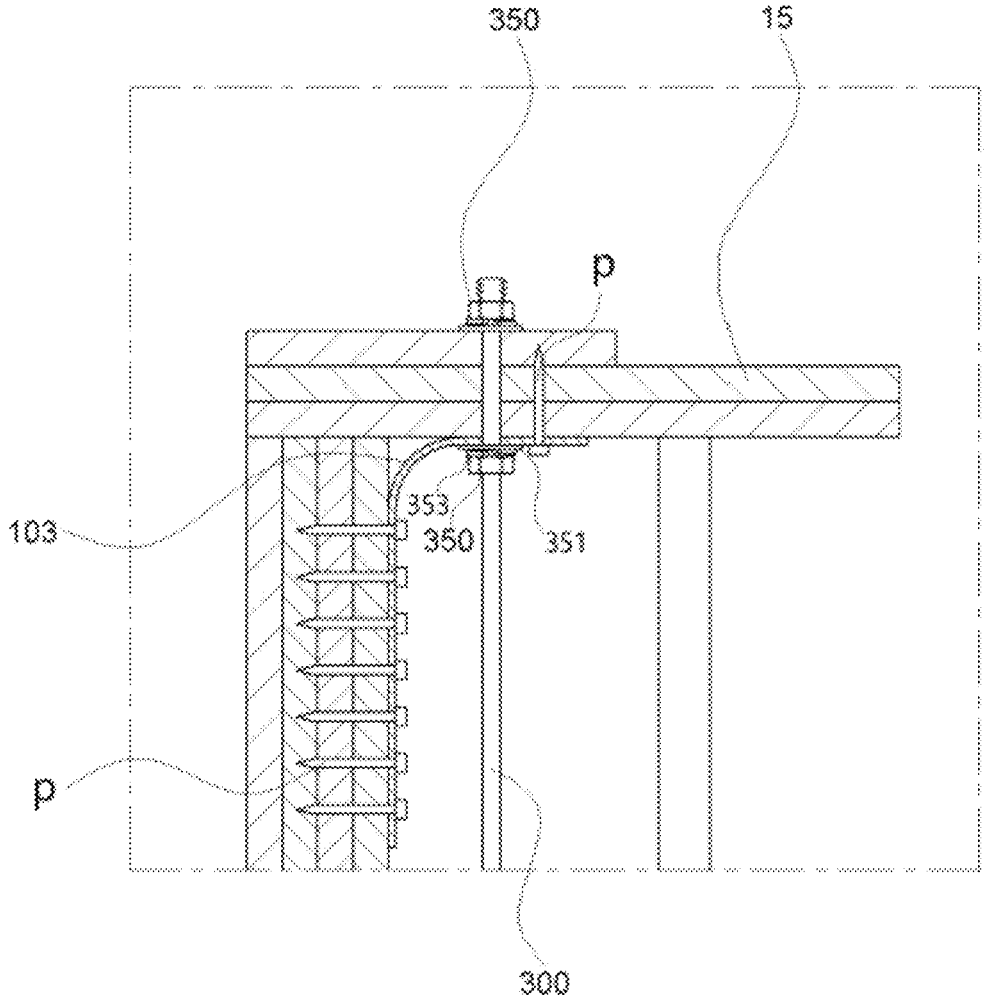
FIG. 4 is a partial side sectional view showing a state in which the upper end of a connection support rod included in a seismic reinforcement structure according to an embodiment of the present invention is fixed to a ceiling part.

FIG. 4 is a partial side sectional view showing a state in which the upper end of the connection support rod included in the seismic reinforcement structure according to an embodiment of the present invention is fixed to a ceiling part.

As shown in FIG. 4, the upper end of the connection support rod 300 penetrates the through hole 111 of the second bracket 103 and the ceiling part 15. In order to prevent the connection support rod 300 from being separated from the through hole 111 of the second bracket 103 and the ceiling part 15, nuts 350 are provided on the top and bottom sides of the portion in which the connection support rod 300 penetrates the ceiling 15 and the second bracket 103. In this case, flat washers 351 are inserted between the nuts 350 and the ceiling part 15 in order to come into contact with the ceiling part 15, and spring washers 353 are again inserted between the flat washers 351 and the nuts 350 that are provided. The flat washers 351 serve to reduce movement by fastening the connection support rod 300 in the through hole 111. The spring washers 353 serve to prevent the nuts 350 and the flat washers 351 from slipping, prevent the nuts 350 from loosening, adjust the clearance of the connection support rod 300, and control the horizontal spacing between the floor part and the ceiling part 15.

The lower end of the connection support rod 300 may be fixed to the floor part 11 in two ways.

FIG. 5 is a side sectional view showing the configuration of an anchor used when a seismic reinforcement structure according to an embodiment of the present invention is applied to a previously constructed building.

First, referring to FIG. 5, the connection relationship and structure of the lower end of the connection support rod 300 when the seismic reinforcement structure according to the embodiment of the present invention is applied to a previously constructed building will be described. As shown in FIG. 5, an anchor hole 510 is formed inside the floor part below the through hole of the first bracket 101. In this case, the anchor hole 510 is formed deep into the first bottom layer 11*a*. The inside of the anchor hole 510 is filled with a chemical anchor 500*a*, which is liquid during construction but hardens and changes into a solid after construction. The lower end of the connection support rod 300 passes through the through hole 111 of the first bracket 101 and is inserted into the anchor hole 510. That is, as the chemical anchor 500*a* hardens, the lower end of the connection support rod 300 comes to complete contact with the chemical anchor 500*a* and is fixed to the floor part 11 not to be easily separated therefrom. In addition, like the upper end of the connection support rod 300, a nut 350 is provided on an upper side where the connection support rod 300 penetrates the through hole of the bracket 101 and is screwed to a male thread formed on the outer circumference of the connection support rod 300. A flat washer 351 is inserted between the nut 350 and the bracket 101 to come into contact with the bracket 101. A spring washer 353 is inserted between the flat washer 351 and the nut 350.

Figure 6:
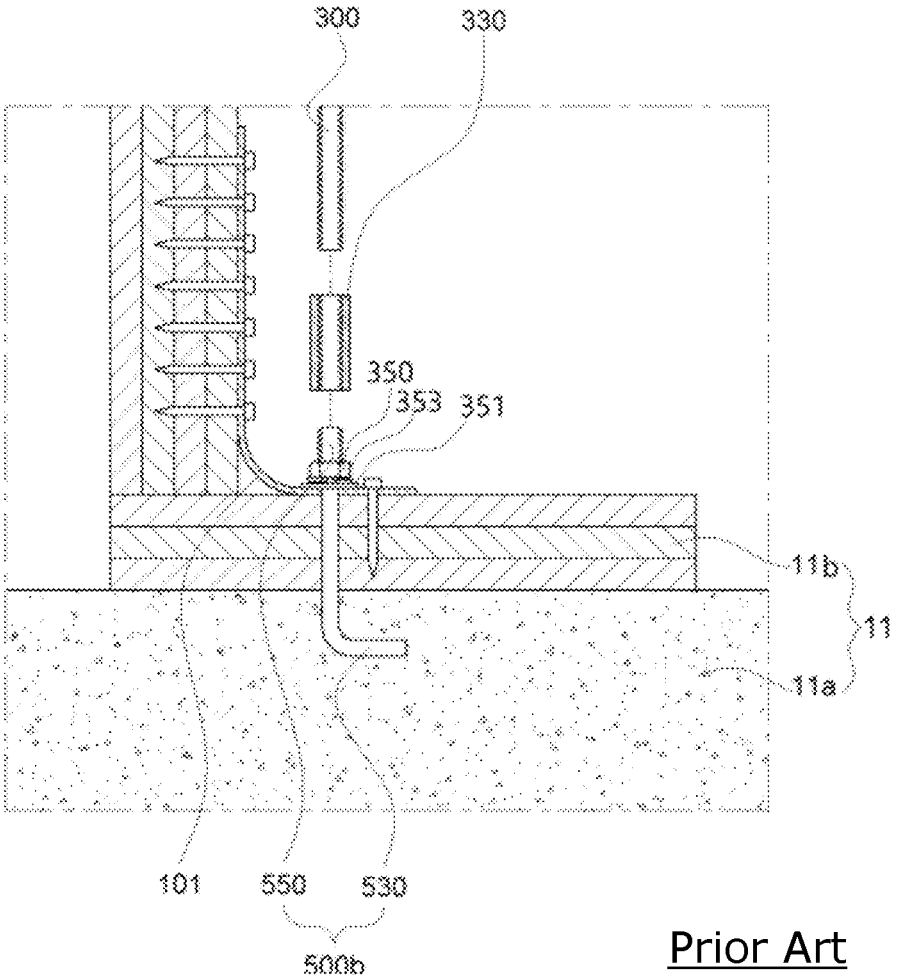
FIG. 6 is a side sectional view showing the configuration of an anchor used when a seismic reinforcement structure according to an embodiment of the present invention is applied to a newly constructed building.

FIG. 6 is a side sectional view showing the configuration of an anchor used when a seismic reinforcement structure according to an embodiment of the present invention is applied to a newly constructed building.

Referring to FIG. 6, the connection relationship and structure of the lower end of the connection support rod 300 when the seismic reinforcement structure according to the embodiment of the present invention is applied to a newly constructed building will be described. As shown in FIG. 6, the anchor 500*b* includes an insertion portion 530 extending approximately in the left and right directions and having a predetermined shape, and a protrusion 550 extending upward from the insertion portion 530. In this case, the insertion portion 530 is welded and fixed to reinforcing bars placed inside the first bottom layer 11*a*, and is buried in the first bottom layer 11*a*. The protrusion 550 penetrates the second bottom layer 11*b*, passes through the through hole 111 provided in the first bracket 101, and protrudes upward from the floor part 11. A male screw is formed on the outer peripheral surface of the protruding upper end. A flat washer 351, a spring washer 353, and a nut 350 are sequentially coupled to the portion of the protrusion 550 above the floor part 11, and then the connection support rod 300 is connected to the protrusion 550 through a connector 330. The connector 330 is formed in the shape of a tube and has a female thread formed on the inner circumferential surface thereof. The upper end of the protrusion 550 is screwed to the lower portion of the connector 330, and the lower end of the connection support rod 300 is screwed to the upper portion of the connector 330.

The connection support rod 300 and the anchor 500*b* provide the advantage of being fixed to the floor part 11 and preventing the building from easily collapsing through the above-described coupling structure when an earthquake occurs, like the roots of a tree Meanwhile, the bracket 100 and the connection support rod 300 have the same coupling relationship as described above, but may have different shapes.

Figure 7:
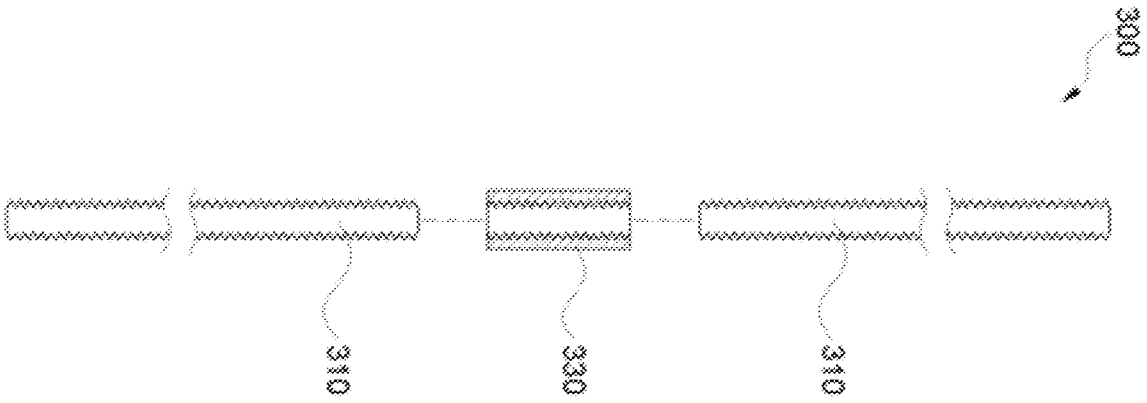
FIG. 7 is an assembly view showing the configurations of the individual parts of a connection support rod included in a seismic reinforcement structure according to another embodiment of the present invention.

FIG. 7 is an assembly view showing the configurations of the individual parts of a connection support rod included in a seismic reinforcement structure according to another embodiment of the present invention.

As the height of the wall of the building 10 varies, the required length of the connection support rod 300 also varies. To overcome this problem, the connection support rod 300 may include a plurality of threaded rods 310 and at least one connector 330. The connector 330 has the same shape as the connector described above. The different threaded rods 310 are coupled to its upper and lower portions of the connector 330, so that they can be connected to each other in succession. That is, an advantage is achieved in that the overall length of the connection support rod 300 may be adjusted through the connector 330. An additional advantage is achieved in that the tension exerted by the connection support rod 300 may be adjusted by adjusting the degrees of insertion of the threaded rods 310 inserted into the connector 330 in the state in which the connection support rod 300 is fixed to the ceiling part and the floor part.

Figure 8:
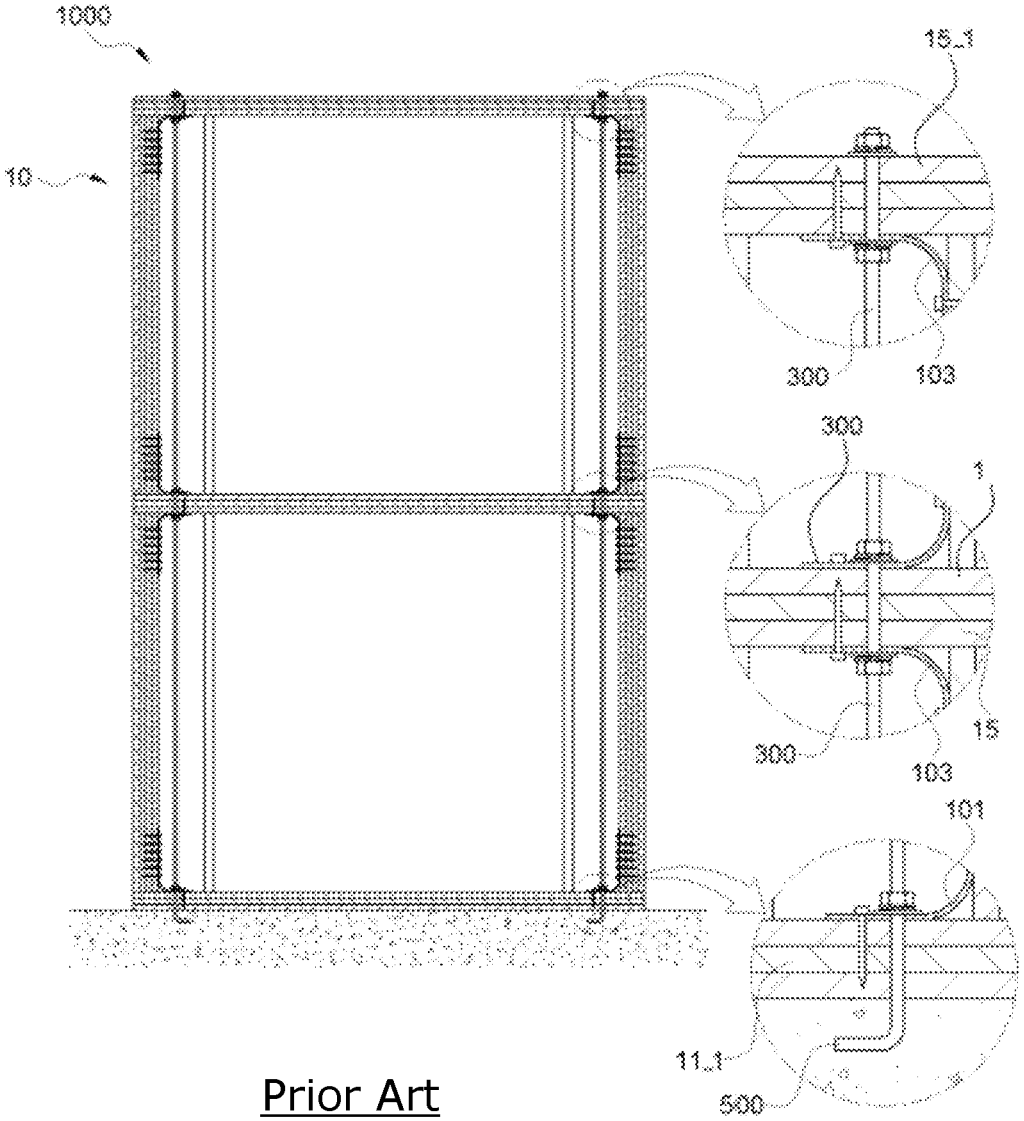
FIG. 8 is a side sectional view showing a case where a building to which a seismic reinforcement structure according to an embodiment of the present invention is applied has a multi-story structure.

FIG. 8 is a side sectional view showing a case where a building to which a seismic reinforcement structure according to an embodiment of the present invention is applied has a multi-story structure.

When the building to which the seismic reinforcement structure according to the embodiment of the invention is applied is a multi-layer structure including two or more floors, the first bracket 101 and the second bracket 103 are installed on each of the floors, as shown in FIG. 8. In this case, the through holes of the first and second brackets 101 and 103 installed on each floor are arranged on the same line in the vertical direction. Furthermore, the upper end of the connection support rod 300 passes through the second bracket 103 installed on the uppermost floor and is fixed to the ceiling part 15_1 of the uppermost floor, and the lower end of the connection support rod 300 is fixed to the anchor 500 provided on the floor part 11_1 of the lowest floor. Furthermore, the intermediate portion of the connection support bar 300 is coupled to pass through the remaining brackets 101 and 103, the ceiling part 15, and the floor part 11, excluding the second bracket 103 and ceiling part 15_1 of the uppermost layer and the first bracket 101 and floor part 11_1 of the lowermost layer. In addition, a flat washer, a spring washer, and a nut 350 are coupled to the portions of the outer circumference of the connection support rod 300 before and after the passage of the intermediate portion of the connection support rod 300 through the floor part 11 or ceiling part 15, so that the location of the connection support rod 300 is fixed. Accordingly, the vibration generated from the connection support rod 300 may be reduced on the penetrated portion of the ceiling part 15 or the floor part 11.

[Seismic Construction Method]

A seismic construction method according to a first embodiment of the present invention will be described in detail below. The seismic construction method to be described below is a sequential method of forming the seismic reinforcement structure described above. Components having the same names or reference numerals as described above are considered the same.

In step 1), reinforcing bars to be included in the floor part 11 of the building 10 are arranged. In this case, the reinforcing bars may be placed after the ground has been excavated to a predetermined area. Multiple reinforcing bars are arranged in the form of a grid on a plane horizontal to the ground, and the contact points of different reinforcing bars that cross each other may be welded.

In step 2), the insertion portion 530 is fixed to the reinforcing bar so that the protrusion 550 of the anchor **500*b* protrudes at the location where the first bracket 101 is to be installed. The insertion portion 530 of the anchor 500*b* is formed in the horizontal direction as shown in FIG. 6**, and is preferably fixed to a reinforcing bar arranged in the horizontal direction through welding.

In step 3), the first floor layer **11*a* of the building 10 is formed by pouring concrete so that the reinforcing bars and the insertion portion 530 are buried. In this case, a second floor layer 11*b* made of lightweight wood is further stacked on top of the first floor layer 11*a* made of concrete. The protrusion 550 protrudes upward from the floor part 11**.

In step 4, the building 10 is constructed by forming the wall 13 and the ceiling part 15 above the floor part 11. In this case, one part of the wall 13 is formed to stand within a predetermined radius from the protrusion 550.

In step 5), the protrusion 550 is inserted into the through hole 111 formed in the horizontal portion 110 of the first bracket 101, the first bracket 101 is fixed to the floor part 11 and the wall 13, and the second bracket 103 is fixed to the ceiling part 15 and the wall 13 to face the first bracket 101. As described above, the through hole 111 formed in the second bracket 103 is positioned on the same line in the vertical direction as the through hole 111 formed in the first bracket 101, and is then fixed to the ceiling part 15 and the wall 13.

In step 6), the upper end of the connection support rod 300 is fixed by being passed through the horizontal portion 110 of the second bracket 103 and the ceiling part 15, and the lower end of the connection support rod 300 is connected to the protrusion 550. As a method of fixing the upper end of the connection support rod 300 to the ceiling part 15, the upper end of the connection support rod 300 to the ceiling part 15 may be fixed by tightening the nut 350 to the upper end of the connection support rod 300 protruding through the ceiling part 15. As a method of connecting the lower end of the connection support rod 300 to the protrusion 550, the lower end of the connection support rod 300 may be connected to the protrusion 550 using the connector 330.

In step 7), the tension and length of the connection support rod 300 are adjusted by adjusting the connector 330 and the threaded rod 310 included in the connection support rod 300 to finish the process.

The above-described steps are used to describe the first embodiment when the building 10 has a single-story structure. When the building 10 has a multi-story structure, some of the steps described above are modified. The individual modified steps will be described below.

In step 4), walls, ceiling parts 15, and floor parts 11 are additionally constructed above the floor part to correspond to the number of floors included in the building 10. In this case, as for the remaining floors excluding the uppermost and lowermost floors, in upper and lower floors arranged adjacent to each other, the ceiling part of the lower floor may be on the same surface as the floor part of the upper floor.

In step 5) above, the first bracket 101 and the second bracket 103 are fixed at opposite positions for each floor, and the first bracket 101 and the second bracket 103 included in each floor are arranged on the same line. In the case of the lowermost floor, the protrusion 550 is inserted into the through hole 111 formed in the horizontal portion of the first bracket 101. The through holes 111 formed in the first bracket 101 and the second bracket 103 installed on each floor are arranged on the same line in the vertical direction for the insertion of the connection support rod 300.

In step 6) above, the upper end of the connection support rod 300 is fixed by being passed through the horizontal portion 110 of the second bracket 103 and the ceiling part 15_1 on the uppermost layer, and the lower end of the connection support rod 300 is connected to the protrusion 550 protruding upward from the floor part of the lowermost layer. For reference, it is obvious that when the building 10 has a multi-story structure, anchors 500 are not provided on the floors excluding the lowest floor to allow the connection support rod 300 to pass therethrough.

A seismic construction method according to a second embodiment of the present invention will be described in detail below. The seismic construction method according to the second embodiment of the present invention is directed to a method of additionally constructing a seismic reinforcement structure in a constructed building.

In step a), an anchor hole 510 is formed by perforating a location, at which the first bracket 101 is to be installed, in the floor part 11 of the building 10. The location where the first bracket 101 is to be installed is preferably set within a predetermined radius from the portion where the floor part 11 and the wall 13 are connected to each other. In this case, the predetermined radius will be a range within the first direction length of the bracket 100.

In step b), the liquid chemical anchor 500*a* is injected into the anchor hole 510.

In step c), the first bracket 101 is fixed to the floor part and the wall, and the second bracket 103 is fixed to the ceiling part 15 and the wall 13 to face the first bracket 101. In this case, the fixing of the second bracket 103 may be performed at a different sequential position and at any time as long as it is performed before step e), which will be described later.

In step d), the lower end of the connection support rod 300 is passed through the horizontal portion 110 of the first bracket 101 and inserted into the anchor hole 510, and the chemical anchor 500*a* is solidified in the anchor hole 510. In this case, the connection support rod 300 is connected perpendicularly to the floor part 11.

In step e), the upper end of the connection support rod 300 is fixed by being passed through the horizontal portion 110 of the second bracket 103 and the ceiling part 15. As in the first embodiment described above, in the second embodiment, a nut 350 may be connected and fixed to the upper end of the connection support rod 300 protruding through the ceiling part 15.

In step f), the tension and length of the connection support rod 300 are adjusted by adjusting the threaded rod 310 and the connector 330 included in the connection support rod 300 to finish the process.

Also in the second embodiment, when the building 10 has a multi-story structure, some of the steps described above are modified. The individual modified steps will be described below.

In step a) above, the anchor hole 510 is formed only in the lowest floor part 11_1 of the building 10.

In step c) above, the first bracket 101 and the second bracket 103 are fixed at opposite positions for each floor, and the first bracket 101 and the second bracket 103 included in each floor are arranged on the same line in the vertical direction.

In step e) above, the upper end of the connection support rod 300 is fixed by being passed through the horizontal portion 110 of the second bracket 100 and the ceiling part 15_1 in the uppermost floor, and the ceiling parts 15 and floor parts 11 of the remaining floors excluding the ceiling part 15_1 of the uppermost floor and the floor part 11_1 of the lowest floor are coupled through the passage of the connection support rod 300 therethrough.

[Seismic Structure to which Reinforcing Bracket is Applied]

Figure 9:
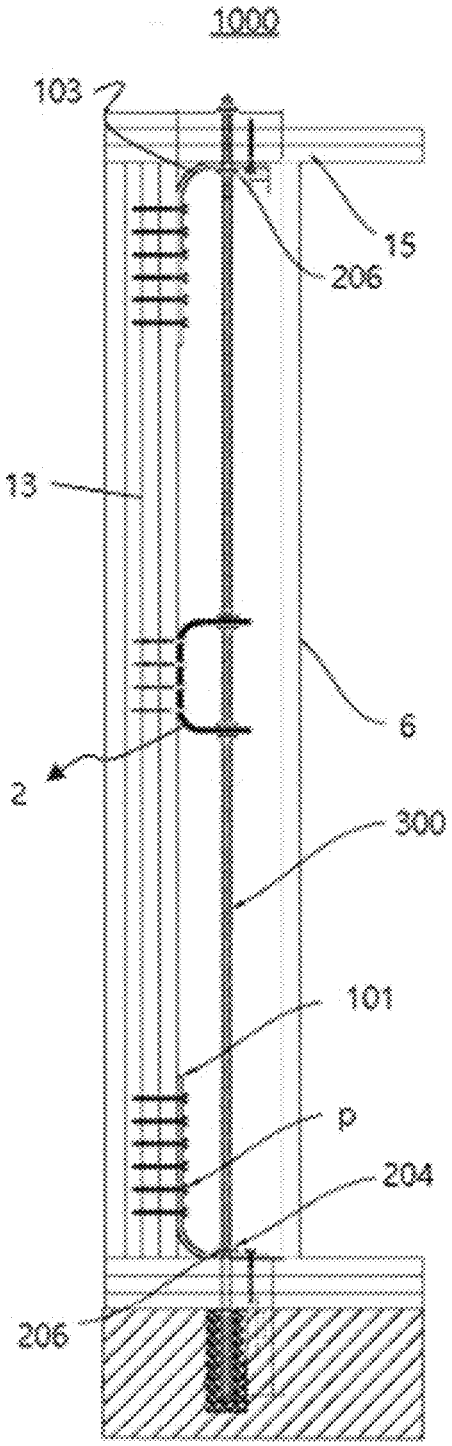
FIG. 9 is a diagram showing a seismic reinforcement structure to which a reinforcing bracket is applied as another embodiment of the present invention.

Next, as another embodiment of the present invention, a seismic reinforcement structure 1000 to which a reinforcing bracket 2 is applied will be described with reference to FIG. 9. The embodiment of FIG. 9 is an improved version of the structure installed in the existing wooden structure of FIG. 5, and the differences between the present embodiment and the previous embodiment will be mainly described.

In the seismic reinforcement structure 1000 of the present invention, a reinforcing bracket 2 is installed between the wall 13 and the connection support rod 300, thereby preventing the distortion or shaking of the wooden building attributable to an earthquake. The reinforcing bracket 2 is disposed at an intermediate height between the first bracket 101 and the second bracket 103. However, the reinforcing bracket 2 may be installed in other places where strength reinforcement is required, and multiple reinforcing brackets may be installed.

FIGS. 10A-10D are diagram showing the reinforcing bracket 2. The reinforcing bracket 2 has a sideways "U" shape when viewed from the side, and includes a flat upper plate 20, a flat lower plate 24 facing the upper plate 20, and a side plate 22 connecting the upper plate 20 and the lower plate 24 to each other and extending in the height direction. A corner portion 26*a* connecting the upper plate 20 and the side plate 22 to each other and a corner portion 26*b* connecting the side plate 22 and the lower plate 24 to each other are rounded. The side plate 22 is installed in close contact with the inner surface of the wall 13. The upper plate 20 and the lower plate 24 each extend parallel to each other from both upper and lower ends of the side plate 22 to a point beyond the connection support bar 300.

Figure 10A:
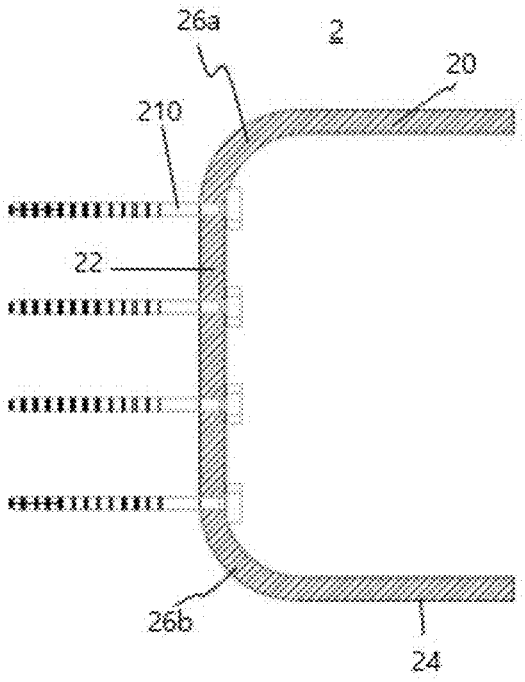
FIGS. 10A-10D are diagram showing a reinforcing bracket according to the present invention.
Figure 10B:
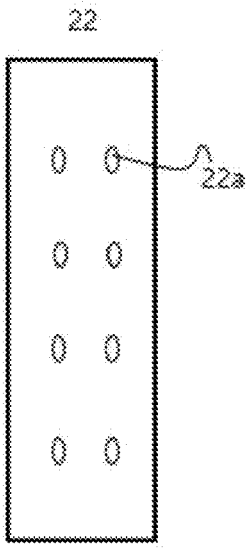

FIG. 10B is a front view of the side plate 22. The side plate 22 has a long rectangular shape. A plurality of piece holes 22*a* are perforated on both sides of the center line so that they are aligned in, for example, four rows.

Figure 10C:
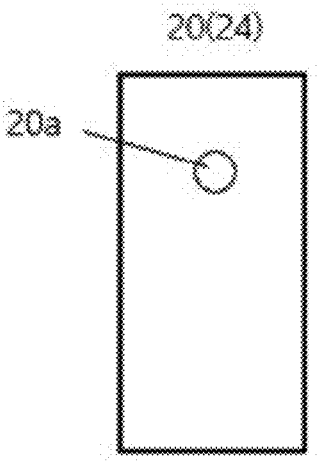

FIG. 10C is a front view of the upper plate 20 and the lower plate 24. Through holes 20*a* are perforated in the portions through which the connection support rod 300 will pass.

Figure 10D:
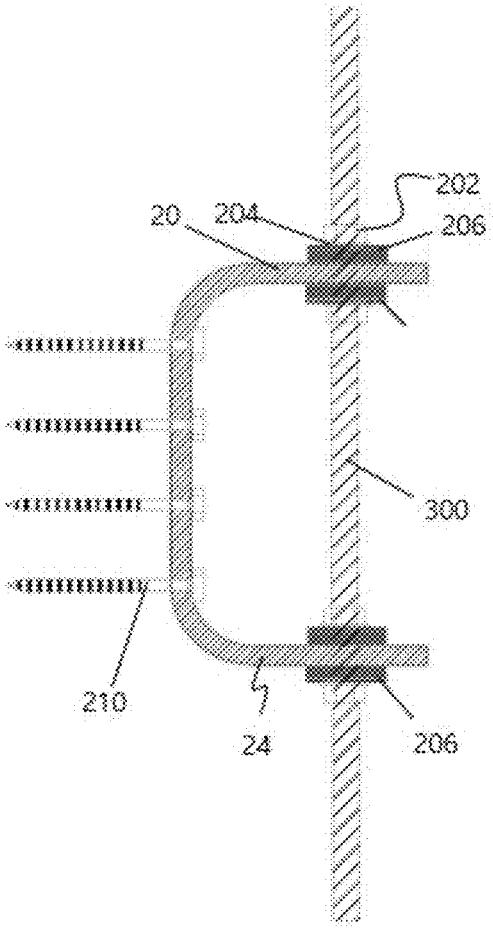

As shown in FIG. 10D, the connection support rod 300 is firmly fastened by being passed vertically through the through holes 20*a* of the upper and lower plates 20 and 24 of the reinforcing bracket 2. Fastening units configured to fasten the upper plate 20 and the connection support rod 300 each include a fastening nut 202, i.e., a hexagonal nut, a washer 204 placed in contact with the fastening nut 202, and an elastic washer 206 placed in contact with the other side of the washer 204 and also in contact with the upper plate 20. The fastening units are symmetrically installed on the top and bottom surfaces of the upper plate 20, respectively. The lower plate 24 is also fastened with the same fastening unit. The fastening structure of the present invention has a stronger fastening force than the conventional fastening structure. In particular, the bulky elastic washer 206 is provided and plays a damping role to absorb shaking caused by an earthquake. The elastic washer 26 is preferably made of rubber. In this manner, according to the present invention, the elastic washer 206, which serves as a damper, is located at an intermediate height, which is the main part of a wooden building, so that earthquake resistance is excellent.

A plurality of pieces 210 are inserted through the piece holes 22*a* of the side plate 22 of the reinforcing bracket 2, and are deeply planted and fixed to the wall 13.

The reinforcing bracket 2 of the present invention is made of steel, so that it is generally a rigid body, but the elastic washer 26 is an elastic body. Accordingly, in particular, when the reinforcing bracket 2 is placed at the intermediate height of a wooden building, the strength of the building may be effectively reinforced, and it is also considerably effective against earthquakes in that it is possible to absorb shear force caused by shaking or twisting and shock and vibration through the connection support rod 300.

As a result of various tests conducted by the present inventor, it is preferable that the reinforcing bracket 2 of the present invention is made of automobile structural steel (ATOS). In particular, ATOS780 is a desirable material that has not been subjected to a hot process. ATOS780 includes 0.20 weight percent or less of carbon, 0.40 weight percent or less of silicon, 2.0 weight percent or less of manganese, 0.03 weight percent or less of phosphorus, 0.005 weight percent or less of sulfur, and a small amount of niobium (Nb), excluding iron. ATOS780 is suitable for steel plates having a thickness of 3.2 mm to 14.0 mm. The tensile strength of ATOS780 is 780 MPa or more, the yield point thereof is 700 MPa or more, and the elongation (%) thereof is 14 or more, which is slightly lower than 20, which is the elongation of ATOS540. In the case of JIS SM490 material, which is widely used as high-strength steel, the tensile strength thereof is 490 MPa. Accordingly, ATOS780 steel is about 59% higher than the tensile strength. ATOS780 steel has about 32% higher tensile strength than SPFH 590Y (SPFH 60Y), which is presented as the material having the highest strength among KS D 3616 machinable hot-rolled high-strength steel sheets for automobiles.

As descried above, ATOS 780 has high strength and excellent cold formability, and is used for boom arms and frames for trucks and trailers. When ATOS 780 is used for the reinforcing bracket 2 of the present invention, high strength may be ensured, thereby preventing the bracket from being damaged, cracked, or distorted by earthquakes. It is obvious that ATOS780 is also used as a material for the first bracket 101 and the second bracket 103 described above.

Referring back to FIG. 9, a stud 6 is installed near the connecting support rod 300 between the ceiling part 15 and the second floor layer 11*b* for the reinforcement of strength.

Another difference between the embodiment of FIG. 9 and the previous embodiment is a structure for connecting the first bracket 101, the second bracket 103, and the connection support rod 300. This will be described with reference to FIG., which shows an enlarged view of a structure for fastening the first bracket 101 and the connection support rod 300.

Figure 11:
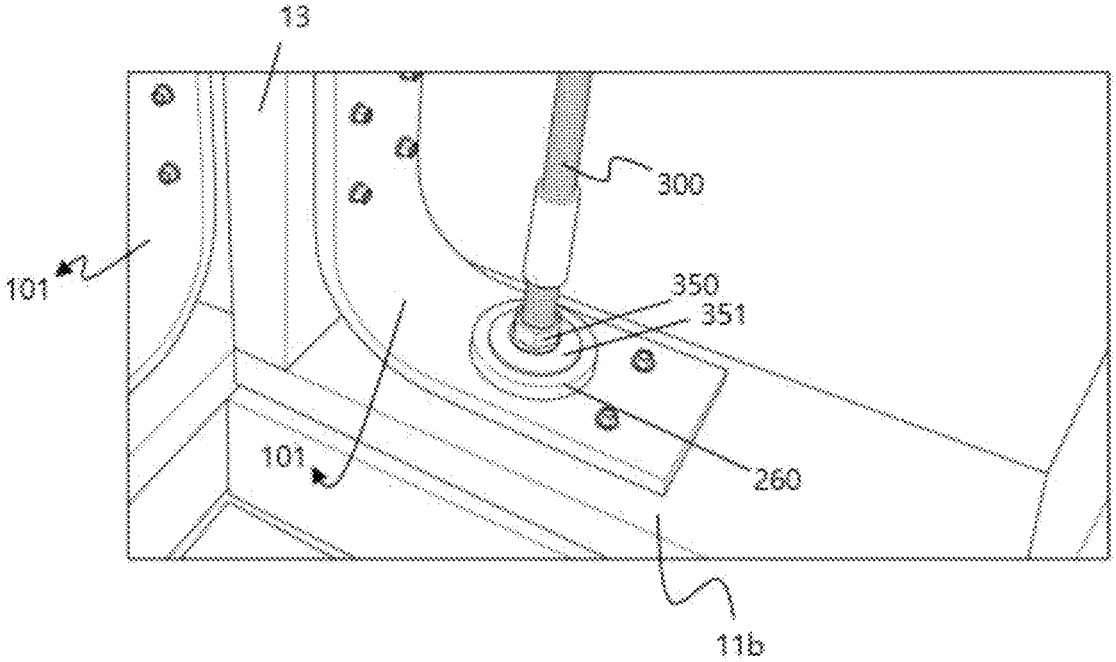
FIG. 11 is an enlarged view showing a fastening structure for the first bracket and the connection support rod.

That is, as shown in FIG. 11, the lower end of the connection support rod 300 includes a nut 350, a washer 351 located between the bottom surface of the nut 350 and the elastic washer 206, and an elastic washer 206 placed in simultaneous contact with the bottom surface of the washer 351 and the top surface of the second floor layer 11*b*. The elastic washer 206 has the same structure as that of FIGS. 10A-10D. The elastic washer 206 closely accommodates the connection support rod 300 through a hole having an inner diameter substantially equal to the outer diameter of the connection support rod 300, has a relatively large size and thickness, and is pressed between the washer 351 and the second floor layer 11*b* by the tightening of the nut 350. Accordingly, the elastic washer 206 serves as an elastic body that is completely structurally integrated with surrounding solid steel members, thereby reducing damage to a wooden building attributable to earthquakes. Although the spring washer similar to a flat washer was used in the above-described embodiment, the elastic washer 206 has a large thickness and a relatively large radius, so that elastic force can be increased.

The structure of FIG. 11 is applied to the second bracket 103 in the same manner.

Figure 12:
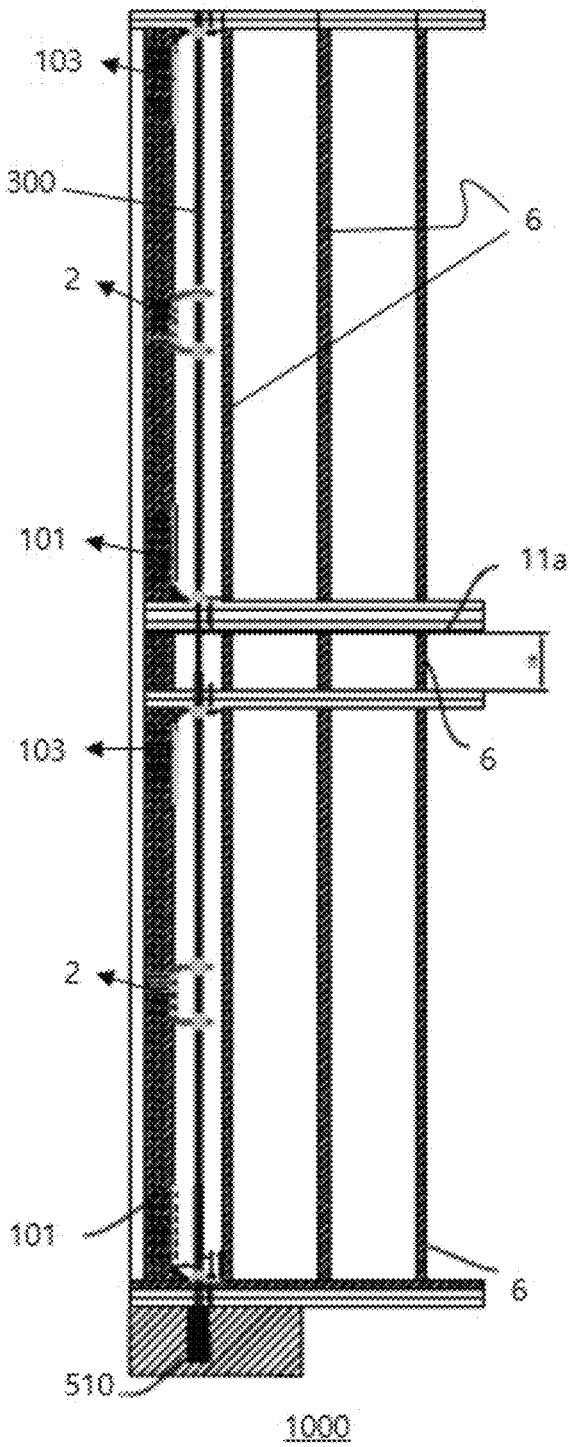
FIG. 12 is a diagram showing a state in which the seismic reinforcement structure of FIG. 9 is applied to a multi-story structure.

FIG. 12 is a diagram showing a double-story wooden building using the reinforcing bracket 2 of the present invention. The first and second floor structures of the building are the same, except that a first floor layer 11*a* is present on the first floor. The building has a repetitive structure in which in each floor, first and second brackets 101 and 103 are installed on the upper and lower portions of a wall 13 and a reinforcing bracket 2 is installed between the brackets 101 and 103. That is, the seismic structures of the present invention are installed independently in each floor, and in the case of the same floor, a plurality of seismic structures are installed in necessary places along the corners of the wall 13 to ensure sufficient earthquake resistance. Even when reference is made to the two-story structure of FIG. 12, 12 elastic washers 206 are arranged from top to bottom, so that elastic bodies are installed in the intermediate portions of the interior of the wooden building, with the result that an earthquake resistance effect is particularly excellent.

In the present invention, seismic modules each including the first bracket 101, the second bracket 103, the reinforcing bracket 2, and the connecting support rod 300 are most preferably installed along the corners of the wall 13. That is, as shown in part of FIG. 11, a first bracket 101 is installed at one corner of the wall 13, and another first bracket 101 is installed at an adjacent corner of the wall 13.

Figure 13:
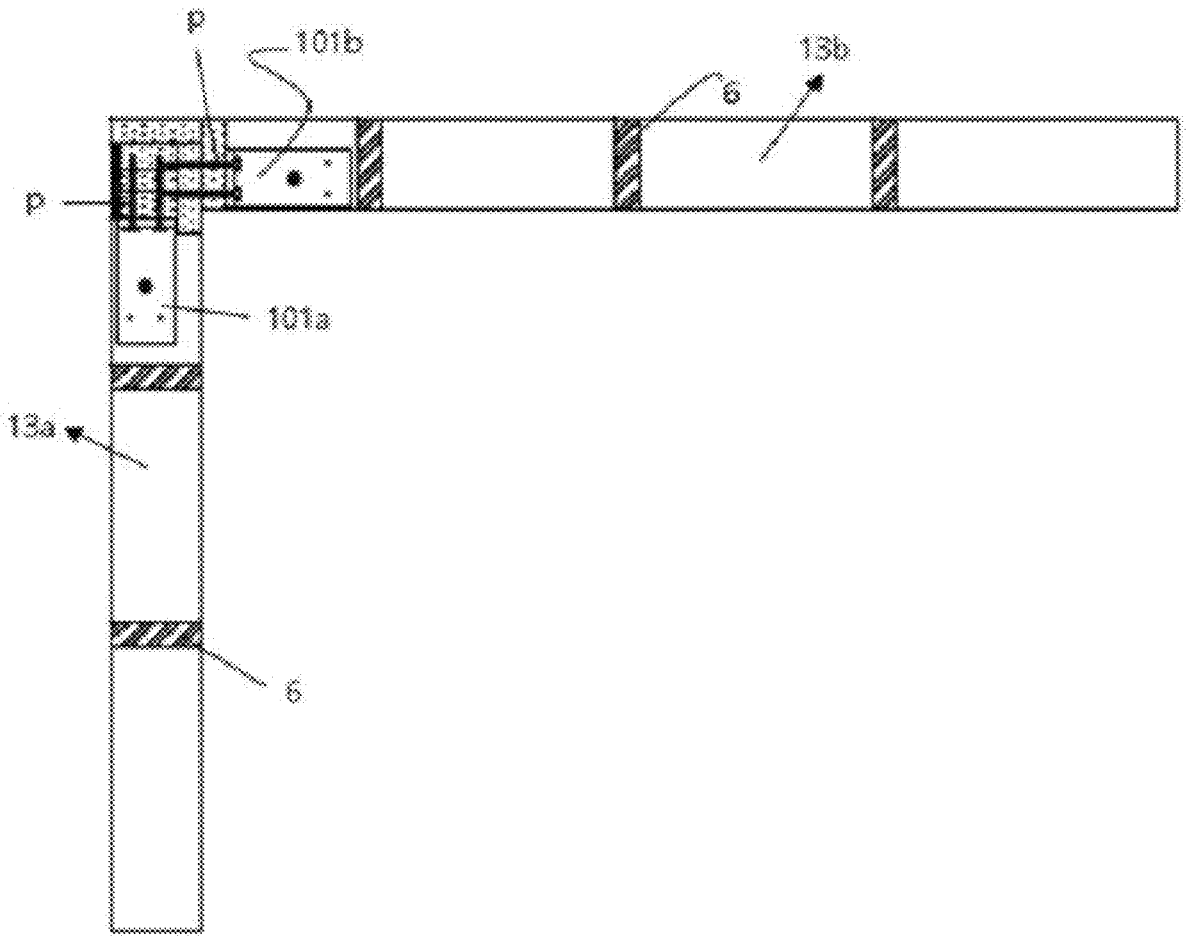
FIG. 13 is a diagram illustrating a state in which the seismic reinforcement structure of the present invention is applied to the corners of walls.

In this case, the drawing viewed from above in the state in which the corner of the wall 13 is cut in FIG. 13 illustrates the reinforcement structure of the wall 13 in more detail. At the corner where the first wall 13*a* and the second wall 13*b* are vertically connected, a first bracket 101*a* is installed on the first wall 13*a*, and another first bracket 101*b* is installed on the second wall 13*b*. At the corner portion to which each of the first wall 13*a* and the second wall 13*b* is connected, the piece p of the first bracket 101*a* penetrates the inside of the first wall 13*a*), and the piece p of the first bracket 101*b* penetrates the inside of the second wall 13*b*. Since the pieces p intersect each other vertically in the corner portion, the corner portion is ultimately and dually reinforced by the plurality of vertically intersecting pieces p. Each corner of the building, which is an important part of a wooden building, is reinforced in a dual manner, the second bracket 103 is installed in the same manner, and the reinforcing bracket 2 is installed in the same manner. Ultimately, all the corners of the wooden building are each supported by a dual reinforcement structure and a dual elastic structure, thereby improving the durability of the wooden building and providing excellent earthquake resistance.

The seismic reinforcement structure and seismic construction method of the present invention configured as described above provide support between a wall and a floor part or between a wall and a ceiling part through the configurations of the brackets, so that there is provided the advantage of supporting left and right vibration.

In particular, the vertical part elastically supports a wall with respect to the horizontal part due to the shape characteristics of the curved part, so that there are provided the advantages of absorbing left and right vibration and improving earthquake resistance.

Furthermore, through the ratio between the lengths of the horizontal and vertical parts, the surface of a wall may be effectively supported without a large load being applied to the horizontal part.

Furthermore, the distance between ceiling and floor parts are kept constant through the configuration of the connection support rod, so that there is provided the advantages of supporting the ceiling part and dispersing the load concentrated on a wall when vibration occurs in the vertical direction.

Furthermore, the length may be adjusted through the configuration of the connection support rod including the threaded rod and the connector, so that there are provided the advantages of enabling custom-application to buildings having various heights and adjusting the tension applied between ceiling and floor parts.

Furthermore, through the structure of the anchor, the connection support rod is fixed to the floor part of a building, so that the relative position of the overall building with respect to the floor part is fixed, which provides the advantage of preventing the collapse of the building.

Moreover, the strength of a wooden building may be further increased and earthquake resistance may be improved by using the intermediate bracket.

Although the embodiments of the present invention have been described above, it is obvious that various alterations and modifications may be made to the present invention and that the scope of the present invention extends to the ranges identical or equivalent to the range of the claims to be described below.

What is claimed is:

1. A system comprising:

a wooden structure building including a floor part, a wall vertically connected to the floor part, and a ceiling part vertically connected to the wall and arranged parallel to the floor part; and a seismic reinforcement structure comprising:

a first bracket connecting a top surface of the floor part and an inner surface of one side of the wall; and a second bracket connecting a bottom surface of the ceiling part and an inner surface of an opposite side of the wall;

wherein the first bracket includes a horizontal planar portion formed without bending and coupled to the top surface of the floor part, a vertical planar portion formed without bending and coupled to the inner surface of the one side of the wall, and a curved portion formed to have a predetermined radius of curvature without bending and connecting one end of the horizontal portion and one end of the vertical portion;

wherein the second bracket includes a horizontal planar portion formed without bending and coupled to a top surface of the ceiling part, a vertical planar portion formed without bending and coupled to the inner surface of the opposite side of the wall, and a curved portion formed to have a predetermined radius of curvature without bending and connecting one end of the horizontal portion of the second bracket and one end of the vertical portion of the second bracket;

wherein the horizontal portion of the first bracket and the horizontal portion of the second bracket are connected by a connection support rod extending vertically, so that when an earthquake occurs, left and right vibration of the wall is allowed by the first and second brackets, which are each formed of flat surfaces without bending and a curved surface;

wherein the left and right vibration of the wall is limited by the connection support rod connecting the horizontal portions of the first and second brackets;

wherein a reinforcing bracket is installed between the wall and the connection support rod at an intermediate height between the first and second brackets, the reinforcing bracket having a sideways U-shaped profile defined by a flat upper plate, a flat lower plate facing the upper plate, and a side plate connecting the upper and lower plates and extending in a height direction; and wherein the connection support rod vertically passes through the horizontal portions of the first and second brackets, the reinforcing bracket and the ceiling part of the building, so that an upper end thereof is fixed to the ceiling part and a lower end thereof is inserted into the floor part of the building.

2. The system of claim 1, wherein the connection support rod includes a plurality of threaded rods formed to be long vertically, having a male thread formed on an outer surface thereof, and arranged one after another in a vertical direction, and a connector formed in a shape of a tube and having a female thread formed on an inner circumferential surface thereof, and configured such that the threaded rods arranged successively are respectively screwed thereinto on both ends thereof, and allows length and tension thereof to be adjusted.

3. The system of claim 1, wherein the seismic reinforcement structure further includes an anchor that is provided to surround the lower end of the connection support rod in a portion of the floor part in which the lower end of the connection support rod is inserted and that fixes the connection support rod.

4. The system of claim 1, wherein:

the seismic reinforcement structure further includes an anchor that has a predetermined shape and includes an insertion portion buried in the floor part and a protrusion extending upward from the insertion part, vertically passing through the first bracket, and protruding upward from the floor part; and the connection support rod vertically passes through the horizontal portion of the second bracket and the ceiling part of the building, so that the upper end thereof is fixed to the ceiling part and the lower end thereof is connected to a top of the protrusion.

5. The system of claim 1, wherein through holes are perforated in the upper and lower plates of the reinforcing bracket, respectively, to allow the connection support rod to pass therethrough, the connection support rod is fastened to the through holes in the upper and lower plates with a fastening nut, a first washer located in contact with the fastening nut, and an elastic washer placed in contact with the first washer and simultaneously placed in contact with the upper and lower plates, and the elastic washer is made of rubber and has a larger diameter than the fastening nut, thereby providing an elastic body serving as a damper.

6. The system of claim 5, wherein each of the first and second brackets is coupled to the connection support rod with a respective said fastening nut, a respective said first washer placed in contact with the respective fastening nut, and a respective said elastic washer placed in contact the respective first washer and placed with simultaneous contact with the floor and ceiling parts, so that elastic bodies provided by the elastic washers are installed at upper, lower, and intermediate points of the connecting support rod.

7. The system of claim 5, wherein the reinforcing bracket is made of automobile structural steel (ATOS) and is not subjected to a hot forming process.

8. The system of claim 5, wherein:

the wall includes a first wall and a second wall connected perpendicularly to the first wall, and connection portions of the first and second walls provide a corner portion;

the first bracket, the second bracket, the reinforcing bracket, and the connection support rod form a first seismic module and are installed at the corner portion connected to the first wall; and a second seismic module identical to the first seismic module is installed at the corner portion connected to the second wall, so that the corner portions of the walls are supported by the first and second seismic modules in a dual manner and also improve earthquake resistance.

* * * * *